US012048337B2

(12) United States Patent
Lambie

(10) Patent No.: US 12,048,337 B2
(45) Date of Patent: Jul. 30, 2024

(54) USER WORN ATTACHMENT DEVICE AND METHOD OF USE

(71) Applicant: Michael Lambie, Pflugerville, TX (US)

(72) Inventor: Michael Lambie, Pflugerville, TX (US)

( * ) Notice: Subject to any disclaimer, the term of this patent is extended or adjusted under 35 U.S.C. 154(b) by 134 days.

(21) Appl. No.: 17/853,212

(22) Filed: Jun. 29, 2022

(65) Prior Publication Data

US 2024/0000165 A1 Jan. 4, 2024

(51) Int. Cl.
*A41D 1/04* (2006.01)
*A41D 13/00* (2006.01)

(52) U.S. Cl.
CPC ..... *A41D 1/04* (2013.01); *A41D 13/0007* (2013.01)

(58) Field of Classification Search
CPC .. A41D 1/04; A41D 13/0007; A45F 2003/146
USPC ..... 224/263, 268; 2/263, 260
See application file for complete search history.

(56) References Cited

U.S. PATENT DOCUMENTS 6,035,440 A * 3/2000 Woodyard ..... A41D 13/0007 2/102
6,328,618 B1 * 12/2001 Fleischli ..... B63C 9/115 441/106
6,447,037 B1 9/2002 Crouch
11,000,109 B2 5/2021 Ullmann
2002/0040493 A1 * 4/2002 Wooley ..... A41D 13/0012 2/102
2003/0178454 A1 * 9/2003 Guminski ..... A01M 31/004 224/268
2004/0159756 A1 8/2004 Albertson
2009/0032559 A1 2/2009 Fragale
2015/0374043 A1 * 12/2015 Dahl ..... A41D 1/04 2/102
2016/0227910 A1 * 8/2016 Campbell ..... A45F 5/00
2016/0270554 A1 * 9/2016 Silverman ..... A41D 27/20

FOREIGN PATENT DOCUMENTS

WO WO-9501112 A2 * 1/1995 ..... A45C 13/30
WO WO2005023684 3/2005

* cited by examiner

*Primary Examiner* — Alissa L Hoey
*Assistant Examiner* — Akwokwo Olabisi Redhead

(57) ABSTRACT

A user worn attachment device for engaging handle straps of bags to allow for hands free carrying of the bags includes a vest, which can be donned by a user. A plurality of hooks is attached to the vest, with each hook being selectively attachable to one or more handle straps of a bag. The bag and its contents thus are attached to the vest and carriable by the user without using their hands.

7 Claims, 7 Drawing Sheets

USER WORN ATTACHMENT DEVICE AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to attachment devices and more particularly pertains to a new attachment device for engaging handle straps of bags to allow for hands free carrying of the bags. The present invention discloses an attachment device comprising a vest to which a plurality of hooks is attached, wherein bags are attachable to the hooks by means of the handle straps.

(2) Description of Related Art Including Information Disclosed Under 37 CFR 1.97 and 1.98

The prior art relates to attachment devices, which may comprise straps with hooks attached to their opposed ends, clips for attaching bags to user worn belts, and straps attached to hook shaped support arms. What is lacking in the prior art is an attachment device comprising a vest to which a plurality of hooks is attached.

BRIEF SUMMARY OF THE INVENTION

An embodiment of the disclosure meets the needs presented above by generally comprising a vest, which is configured to be donned by a user. A plurality of hooks is attached to the vest, with each hook being configured to attach to one or more handle straps of a bag. The bag and its contents thus are attached to the vest and carriable by the user without using their hands.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
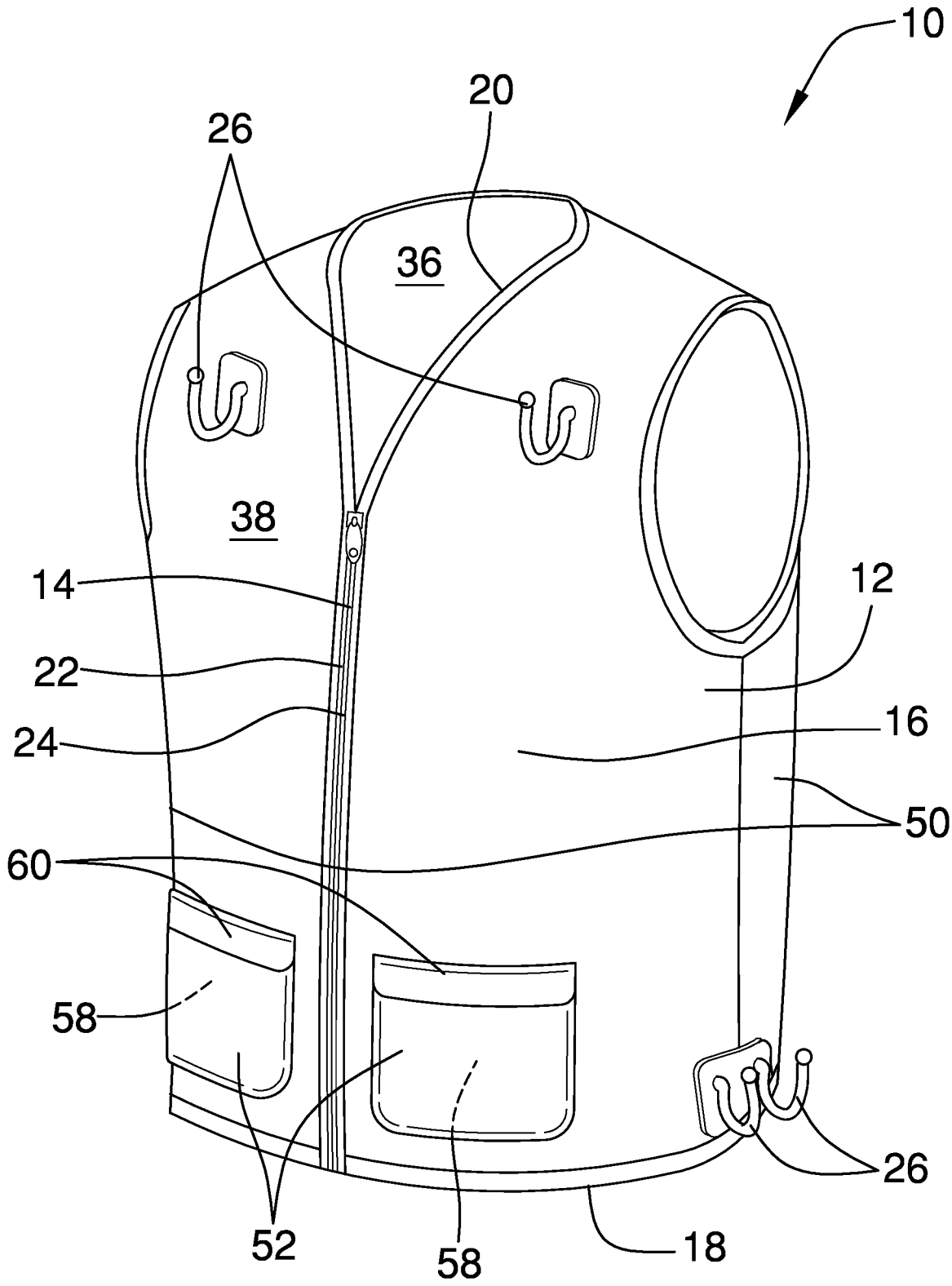
FIG. 1 is an isometric perspective view of a user worn attachment device according to an embodiment of the disclosure.

With reference now to the drawings, and in particular to FIGS. 1 through 7 thereof, a new attachment device embodying the principles and concepts of an embodiment of the disclosure and generally designated by the reference numeral 10 will be described.

Figure 2:
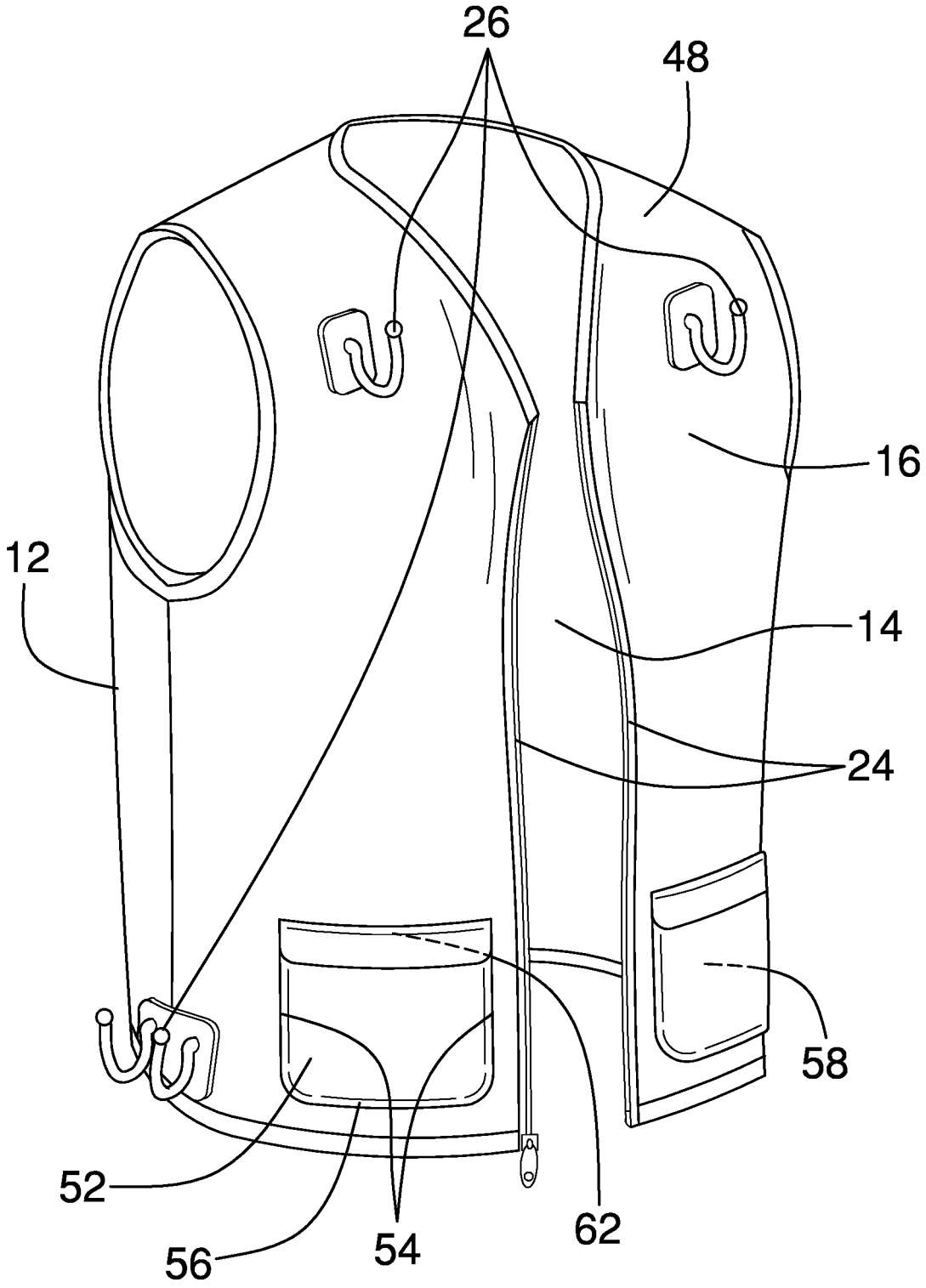
FIG. 2 is an isometric perspective view of an embodiment of the disclosure.

As best illustrated in FIGS. 1 through 7, the user worn attachment device 10 generally comprises a vest 12, which is configured to be donned by a user. In many respects, the vest 12 resembles a fishing jacket. The present invention anticipates the vest 12 comprising water impermeable material. A slit 14 is positioned in a front portion 16 of the vest 12 and extends from a waistline 18 to a neckline 20 of the vest 12. A closure 22 is attached to the vest 12 and extends along the slit 14. The closure 22, which may comprise a zipper 24, as shown in FIG. 2, buttons, hook 26 and loop fasteners, or the like, is positioned to selectively close the slit 14.

A plurality of hooks 26 is attached to the vest 12, with each hook 26 being configured to attach to one or more handle straps 28 of a bag 30. The bag 30 and its contents 32 thus are attached to the vest 12 and carriable by the user without using their hands. The present invention is anticipated to be useful in hands free carrying of any type of bag 30 having handle straps 28, such as, but not limited to, t-shirt bags, corded handle bags, and the like. The hooks 26 of the user worn attachment device 10 also could be used for attachment of other items to the vest 12.

Figure 3:
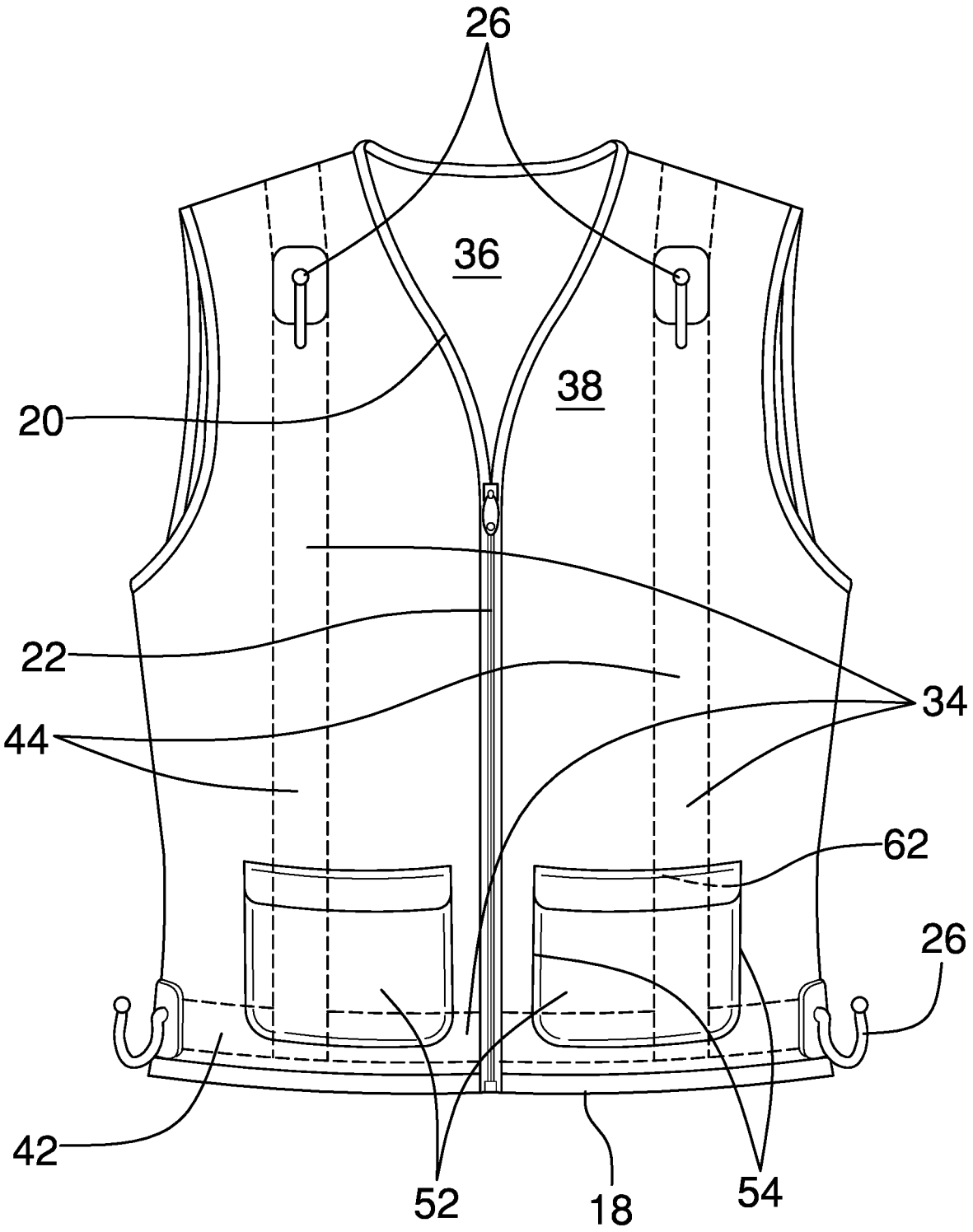
FIG. 3 is a front view of an embodiment of the disclosure.
Figure 4:
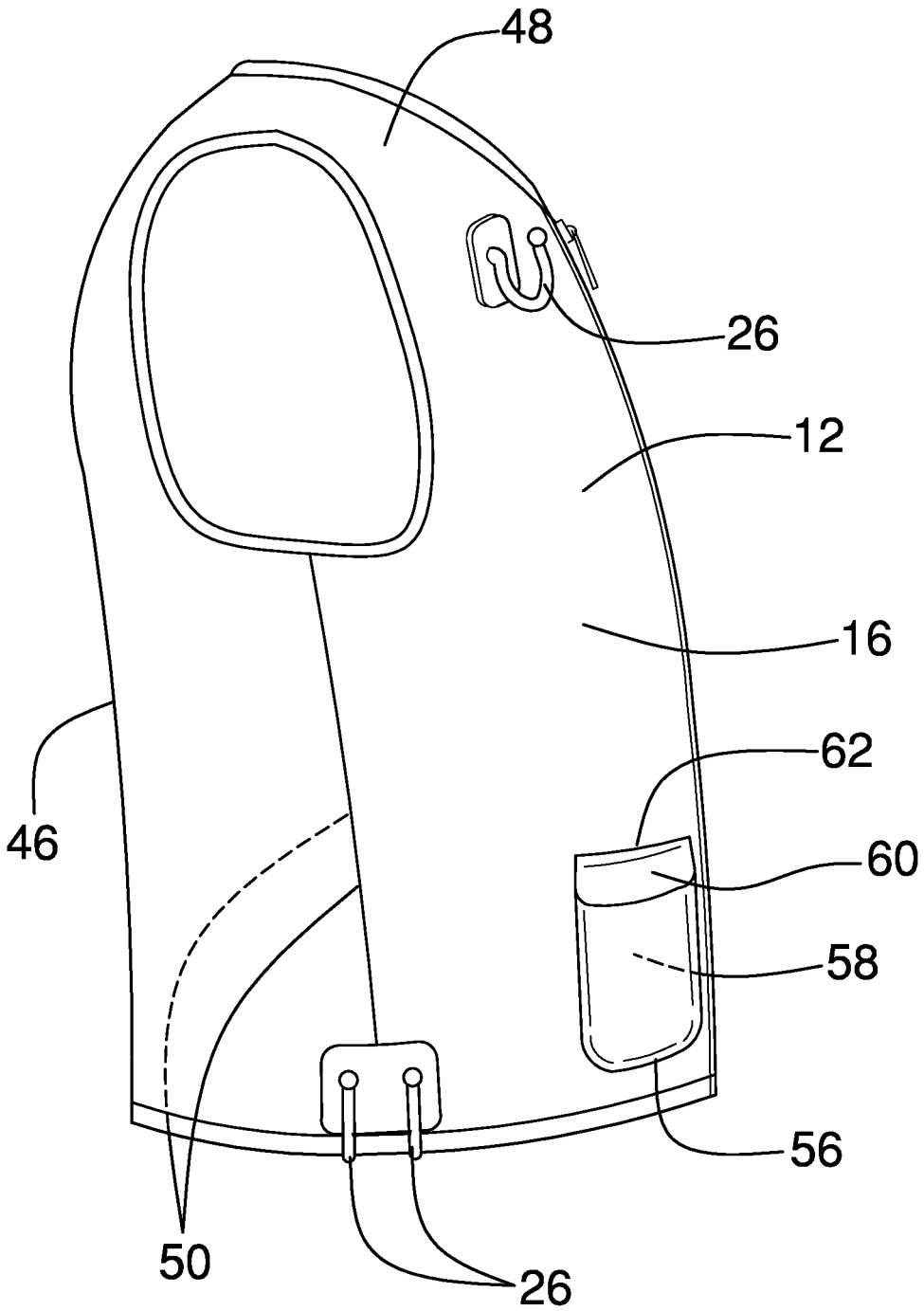
FIG. 4 is a side view of an embodiment of the disclosure.
Figure 5:
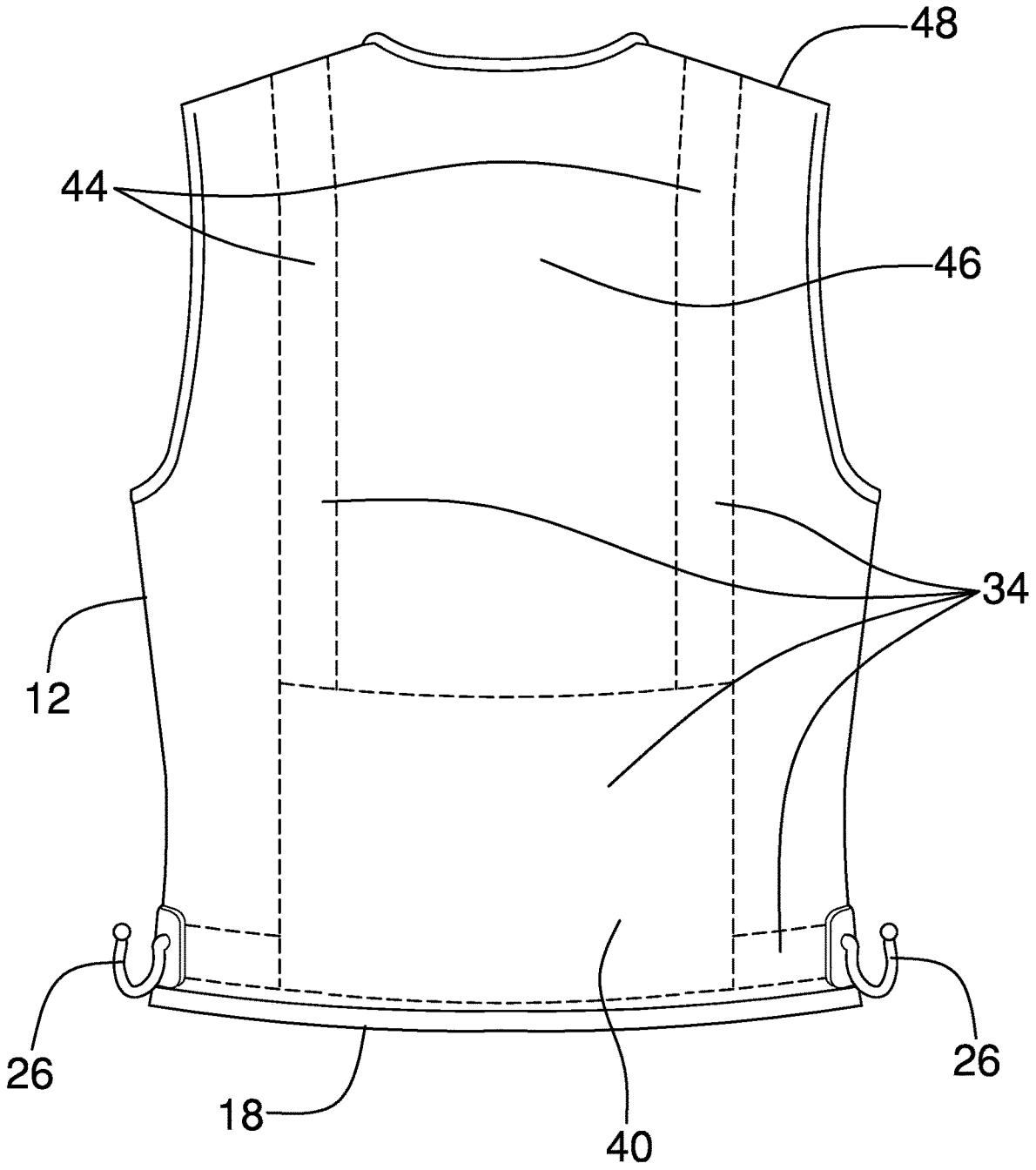
FIG. 5 is a rear view of an embodiment of the disclosure.
Figure 6:
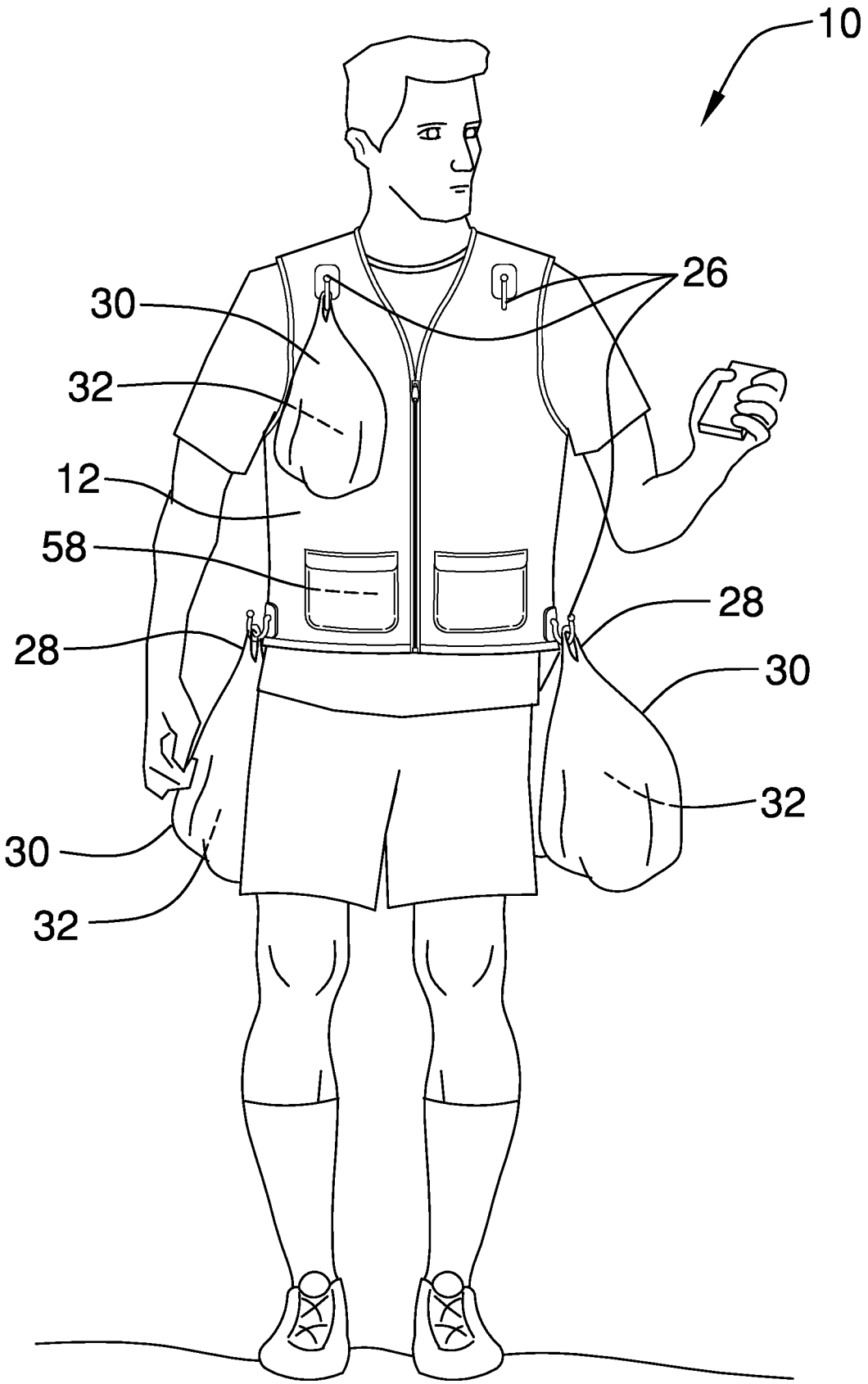
FIG. 6 is an in-use view of an embodiment of the disclosure.
Figure 7:
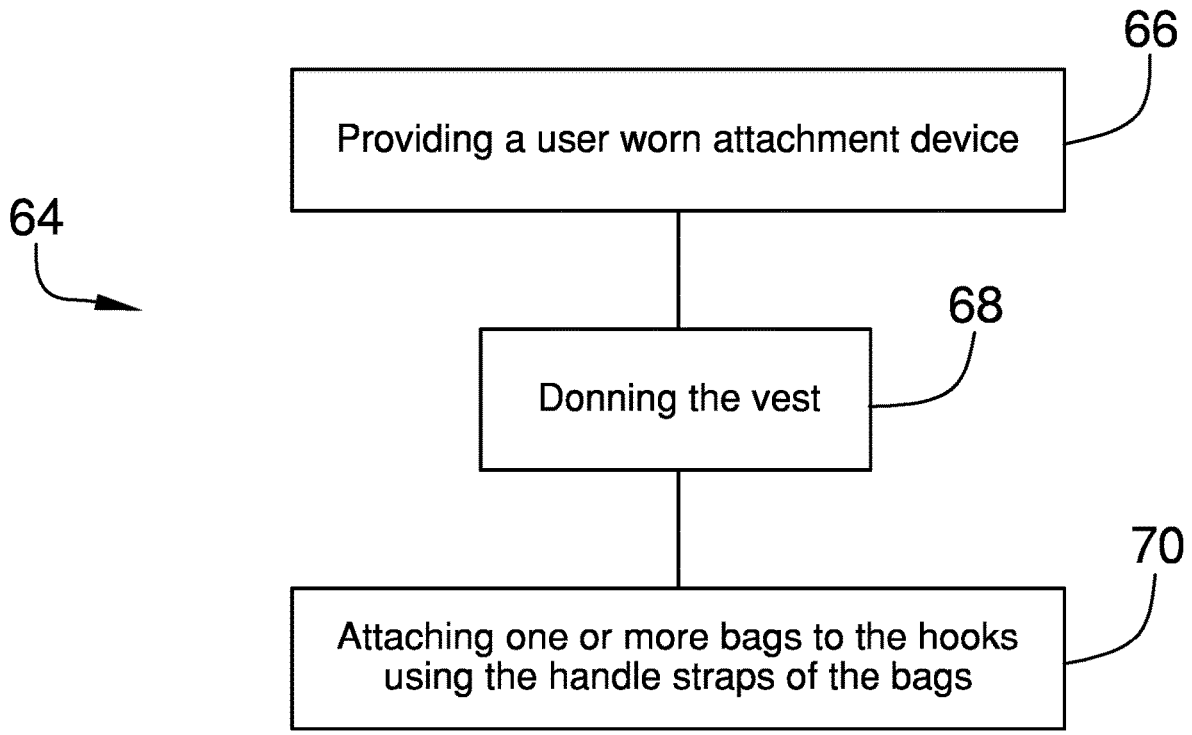
FIG. 7 is a flow diagram for a method utilizing an embodiment of the disclosure.

A harness 34 is attached to the vest 12 and is configured to distribute a mass of the contents 32 in the bags 30 across a torso of the user. As shown in FIGS. 3 and 5, the harness 34 is attached to an inner surface 36 of the vest 12, although the present invention also anticipates the harness 34 being attached to an outer surface 38 of the vest 12.

The harness 34 comprises a pad 40, a waist strap 42, and a pair of shoulder straps 44. The pad 40 is attached to a rear portion 46 of the vest 12, proximate to the waistline 18, and is configured to support a back of the user. The waist strap 42 extends from the pad 40 around the waistline 18. Each shoulder strap 44 extends from the pad 40 over a respective shoulder portion 48 of the vest 12 and along the front portion 16 to the waistline 18. As shown in FIGS. 1 and 2, the plurality of hooks 26 comprises four hooks 26 that are attached to the waist strap 42 positioned two apiece on opposed sides 50 of the vest 12 so that the hooks 26 positioned over a respective hip of the user. The plurality of hooks 26 also comprises two hooks 26 that are attached singly to the shoulder straps 44 so that each hook 26 is positioned over a front of a respective shoulder of the user. The present invention also anticipates other configurations of hooks 26, such as hooks 26 attached to the waist strap 42 along the front portion 16 of the vest 12 and hooks 26 attached to the shoulder straps 44 close to the pad 40.

The user worn attachment device 10 also may comprise a plurality of panels 52. Each panel 52 has opposed edges 54 and a bottom edge 56 that attached to the vest 12 so that the panel 52 defines a pocket 58, which is configured to stow an article, such as a phone, keys, wallet, or the like. Each flap 60 of a plurality of flaps 60 is attached to the vest 12 proximate to a top edge 62 of a respective panel 52 so that the flap 60 is positioned to selectively close an associated pocket 58. As shown in FIG. 3, two panels 52 are attached to the front portion 16 of the vest 12 and define two pockets 58 proximate to the waistline 18 of the vest 12. Other configurations of pockets 58 are anticipated by the present invention.

In use, the user worn attachment device 10 enables a method for hands free carrying of bags 64. The method 64 comprises a first step 66 of providing a user worn attachment device 10 according to the specification above. A second step 68 of the method 64 is donning the vest 12. A third step 70 of the method 64 is attaching one or more bags 30 to the hooks 26 using the handle straps 28 of the bags 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A user worn attachment device;

a vest configured to be donned by a user;

a plurality of hooks attached to the vest, wherein each hook is configured for attaching to one or more handle straps of a bag, such that the bag and its contents are attached to the vest and carriable without using hands of the user;

a harness attached to the vest, wherein the harness is configured for distributing a mass of the contents in the bags across a torso of the user, wherein the harness comprises:

a pad attached to a rear portion of the vest proximate to the waistline, wherein the pad is configured for supporting a back of the user;

a waist strap extending from the pad around the waistline; and a pair of shoulder straps, each shoulder strap extending from the pad over a respective shoulder portion of the vest and along the front portion to the waistline;

wherein the plurality of hooks comprises two hooks attached singly to the shoulder straps, such that each hook is positioned over a front of a respective shoulder of the user; and a plurality of panels, each panel having opposed edges and a bottom edge attached to the vest, such that each panel defines a respective pocket, wherein each pocket is configured for stowing an article.

2. The user worn attachment device of claim 1, further including:

a slit positioned in a front portion of the vest and extending from a waistline to a neckline of the vest; and a closure attached to the vest and extending along the slit, such that the closure is positioned for selectively closing the slit.

3. The user worn attachment device of claim 2, wherein the closure comprises a zipper.

4. The user worn attachment device of claim 1, wherein the harness is attached to an inner surface of the vest.

5. The user worn attachment device of claim 1, wherein the plurality of hooks comprises four hooks attached to the waist strap and positioned two apiece on opposed sides of the vest, such that two hooks are positioned over each hip of the user.

6. The user worn attachment device of claim 1, further including a plurality of flaps, each flap being attached to the vest proximate to a top edge of a respective panel, such that each flap is positioned for selectively closing the respective pocket.

7. A user worn attachment device:

a vest configured to be donned by a user;

a slit positioned in a front portion of the vest and extending from a waistline to a neckline of the vest;

a closure attached to the vest and extending along the slit, such that the closure is positioned for selectively closing the slit, the closure comprising a zipper;

a plurality of hooks attached to the vest, wherein each hook is configured for attaching to one or more handle straps of a bag, such that the bag and its contents are attached to the vest and carriable without using hands of the user;

a harness attached to the vest, wherein the harness is configured for distributing a mass of the contents in the bags across a torso of the user, the harness being attached to an inner surface of the vest, the harness comprising:

a pad attached to a rear portion of the vest proximate to the waistline, wherein the pad is configured for supporting a back of the user, a waist strap extending from the pad around the waistline, the plurality of hooks comprising four hooks attached to the waist strap and positioned two apiece on opposed sides of the vest, such that two hooks are positioned over each hip of the user, and a pair of shoulder straps, each shoulder strap extending from the pad over a respective shoulder portion of the vest and along the front portion to the waistline, the plurality of hooks comprising two hooks attached singly to the shoulder straps, such that each hook is positioned over a front of a respective shoulder of the user;

a plurality of panels, each panel having opposed edges and a bottom edge attached to the vest, such that each panel defines a respective pocket, wherein each pocket is configured for stowing an article; and a plurality of flaps, each flap being attached to the vest proximate to a top edge of a respective panel, such that each flap is positioned for selectively closing the respective pocket.

* * * * *